US009212663B2

(12) United States Patent
O'Neill

(10) Patent No.: US 9,212,663 B2
(45) Date of Patent: Dec. 15, 2015

(54) ALL-SUPERSONIC DUCTED FAN FOR PROPELLING AIRCRAFT AT HIGH SUBSONIC SPEEDS

(71) Applicant: Terrence O'Neill, Carlyle, IL (US)

(72) Inventor: Terrence O'Neill, Carlyle, IL (US)

( * ) Notice: Subject to any disclaimer, the term of this patent is extended or adjusted under 35 U.S.C. 154(b) by 0 days.

(21) Appl. No.: 13/999,193

(22) Filed: Jan. 27, 2014

(65) Prior Publication Data

US 2015/0098834 A1 Apr. 9, 2015

Related U.S. Application Data

(60) Provisional application No. 61/849,513, filed on Jan. 28, 2013.

(51) Int. Cl.

| | |
|---|---|
| ***F04D 29/38*** | (2006.01) |
| ***F04D 21/00*** | (2006.01) |
| ***F01D 5/14*** | (2006.01) |
| ***F04D 29/32*** | (2006.01) |
| *F04D 19/00* | (2006.01) |

(52) U.S. Cl.

CPC ..... *F04D 21/00* (2013.01); *F01D 5/141* (2013.01); *F04D 19/00* (2013.01); *F04D 29/324* (2013.01); *F04D 19/002* (2013.01); *Y10T 29/4932* (2015.01)

(58) Field of Classification Search

None

See application file for complete search history.

(56) References Cited

U.S. PATENT DOCUMENTS

| | | | | |
|---|---|---|---|---|
| 3,030,770 | A * | 4/1962 | Ranard et al. | 137/15.1 |
| 3,675,294 | A * | 7/1972 | Palfreyman et al. | 29/889.21 |
| 3,754,839 | A | 8/1973 | Bodman | |
| 3,762,835 | A * | 10/1973 | Carlson et al. | 416/224 |
| 3,989,406 | A | 11/1976 | Bliss | |
| 4,012,172 | A | 3/1977 | Schwaar | |
| 4,187,738 | A | 2/1980 | Knight | |
| 4,354,804 | A | 10/1982 | Cruzen | |
| 4,726,737 | A | 2/1988 | Weingold | |
| 5,755,554 | A * | 5/1998 | Ryall | 415/199.4 |
| 6,071,077 | A | 6/2000 | Rowlands | |
| 6,609,674 | B2 | 8/2003 | Gabrys | |
| 7,334,990 | B2 | 2/2008 | Lawlor | |
| 7,374,403 | B2 * | 5/2008 | Decker et al. | 416/223 R |
| 7,491,032 | B1 | 2/2009 | Powell | |
| 2004/0042902 | A1 * | 3/2004 | Hornick et al. | 416/189 |

FOREIGN PATENT DOCUMENTS

WO WO 2007138779 A1 * 12/2007

* cited by examiner

*Primary Examiner* — Christopher Verdier
*Assistant Examiner* — Justin Seabe
(74) *Attorney, Agent, or Firm* — Francis P. O'Neill

(57) ABSTRACT

A supersonic fan has at least two fan blades extending radially from a rim surface of a hub and is circumscribed by a duct. An inboard leading edge having an inboard sweep angle rotates at approximately Mach 1 or greater. A low-pressure zone generates propulsion. An inboard flow regime may migrate outboard from the rim surface and contaminate the low-pressure zone, reducing propulsion. An outboard leading edge having an outboard sweep angle extends radially from the inboard leading edge to form an apex. The inboard and outboard sweep angles are each at least approximately 30 degrees and in the opposite direction. An inboard vortex forming near to and as a result of the apex trails circumferentially across the fan blades and is positioned to substantially confine the inboard flow regime to be inboard of the apex, thereby preserving the low-pressure zone and increasing propulsion for the supersonic fan.

26 Claims, 8 Drawing Sheets

ALL-SUPERSONIC DUCTED FAN FOR PROPELLING AIRCRAFT AT HIGH SUBSONIC SPEEDS

CROSS-REFERENCE TO RELATED APPLICATIONS

This application claims priority from U.S. Provisional Application No. 61/849,513, filed Jan. 28, 2013, entitled "ALL-SUPERSONIC DUCTED FAN FOR PROPELLING AIRCRAFT AT HIGH SUBSONIC SPEEDS", the entire contents of which are incorporated herein by reference.

FIELD

The present disclosure relates generally to ducted fan propulsion for aircraft.

BACKGROUND

Propellers driven by reciprocating (piston) engines are widely used in general aviation to economically propel aircraft, particularly those flown by individual private pilots. Costs for economical 2-4 passenger aircraft may begin at $100-300,000. Two or more radial blades shaped as airfoils may rotate about a hub axis, with the chord of each blade twisted out of the plane of rotation by a blade twist angle in order to set a positive angle of attack (AOA) with respect to the relative airflow. The angle of the relative airflow may be approximately calculated by vector summing the axial velocity (arising from aircraft motion) and the blade velocity at any given point along the span of the blade. In order to maintain a positive AOA that is less than a stall angle, the blade twist angle may need to become progressively smaller in moving from the inboard region of the blade to the outboard region because blade velocity is greater at the tip. Unfortunately, high drag may occur as the relative airflow at the tip approaches Mach 1, reducing efficiency, and may limit prop-driven aircraft to low subsonic speeds of less than approximately 350 miles per hour (mph), or approximately Mach 0.5. Prop-driven aircraft may also be limited to flight ceilings of less than approximately 30,000 feet. The propulsion efficiency of a propulsion system may be defined as the thrust divided by the weight of the engine and propeller (or fan), often quoted as a ratio.

Basic turbofan engines typically have several times the thrust per unit weight (propulsion efficiency) as piston engines driving propellers, and so may be used to achieve aircraft speeds of 300-1200 mph where the thrust required to overcome aircraft drag may be higher than at low subsonic speeds, according to approximately the velocity squared. A turbofan may comprise a jet turbine and a propulsion fan, producing both reactive thrust and fan thrust. The fan itself, also sometimes called a rotor, may be constructed of a hub with a plurality of fan blades attached at its rim surface. A duct circumscribing the fan blades may mitigate tip turbulence and improve efficiency over propellers. Aircraft employing ducted turbofans may reach flight ceilings of approximately 50,000 to 60,000 feet. However, the multi-stage compressors and multi-stage turbines often contained within a basic turbofan may experience high heat and stresses, requiring superalloys or exotic metals, making turbofans expensive to build. Additionally, although basic turbofans may generate large amounts of thrust for a military aircraft, a turbofan may consume approximately three times as much fuel as a piston engine, which may make turbofan aircraft relatively expensive to fly. For example, a turbine may consume approximately one pound of fuel per horsepower per hour, whereas a piston engine may consume approximately $1/3^{rd}$ pound per horsepower per hour. Additionally, the lower weight afforded by the turbofan's high propulsion efficiency may be partially cancelled out by the additional fuel that must be carried.

High bypass turbofans may derive most of their thrust from the ducted fan and little from the turbine exhaust, thereby reducing noise and making them ideal for commercial airliners and business aircraft operating at speeds of approximately 300-600 mph. Costs for a 4-6 passenger very light jet with a cruising speed of approximately 450 mph and a cruising altitude of approximately 40,000 feet may be at least approximately $3 million. Unfortunately, the long fan blades commonly used may have a low hub-to-tip ratio (HTR) producing a relative airflow that is subsonic at a root and supersonic at the tip of the blade. For example, a typical fan having a low HTR of 0.3 may, by reciprocal, create a differential in blade speed between the root and the tip, requiring a progressive blade twist to maintain a positive, non-stalling AOA. Additionally, a transonic zone occurring at the intersection of the subsonic and supersonic regions may generate shock wave turbulence that may require additional blade shaping to recover efficiency or may require additional power to overcome additional drag. The blade may be swept progressively backward to keep the leading edge behind a forward shock wave. Blade thickening may be necessary to stabilize a long blade against mechanical flutter, but may add weight and cause shock waves that reduce performance. In summary, thickening, sweeping, twisting, and otherwise shaping a blade in order to compensate for deficiencies in transonic, low HTR fans may require a complex manufacturing process not well suited to an economical high subsonic propulsion system.

A further drawback of a ducted fan and turbine combination optimized for propulsion efficiency is that the fan itself may not be optimized. To demonstrate this, fan efficiency may be defined as thrust divided by drive power, often quoted as pounds per horsepower. Due to the high propulsion efficiency of turbofans, the horsepower used to drive the fan is easily increased by making the turbine bigger and adding fuel which, when combined with a refinement in the fan, may result in more turbofan thrust, but less fan efficiency. For example, a longer blade may create more thrust, and additional drag that is overcome with a bigger turbine, resulting in a fan having less thrust per unit of drive horsepower but producing a turbofan with higher thrust to weight (propulsion efficiency). In conclusion, because the fans being used in high subsonic flight may be optimized in conjunction with a turbine, the fans themselves may not be efficient enough to propel a 2-4 seat aircraft at high subsonic speeds using a more economical reciprocating engine. This may be one reason why piston-driven ducted fans may not yet be efficient enough to reliably achieve high subsonic flight.

Another penalty of prior fan technology may be the use of multi-piece rotors that are heavier and may require that preformed fan blades be welded, bolted, or otherwise attached to a preformed hub, adding weigh and cost. For example, the complexly-shaped blades used in conventional fans may have a low HTR and may be therefore too heavy to be adhesively retained by a compositely formed hub. In addition, the materials of which the fan blade is fabricated may comprise exotic materials such as titanium and which may be too expensive or difficult to co-form with a hub. Also, conventional blades may be formed of heavy materials such as titanium, having a specific gravity of 4.5 grams per cubic centimeter (g/cc), or such as steel having a specific gravity of 7.8 g/cc, creating a higher centrifugal pull on a hub than a lighter material such as aluminum having a specific gravity of only 2.7 g/cc. Additionally, long blades are more susceptible to damage, such as by the ingestion of birds, necessitating an even thicker, heavier blade that precludes adhesion in a one-piece rotor. The result of a multi-piece assembly may be a higher parts count, complex manufacturing tooling, and a greater weight not supportive of economical high subsonic flight. What's needed is a rotor design that reduces the centrifugal pull of preformed fan blades on a composite hub having modest adhesive strength.

Another problem in fan art are the flow regimes that may arise from boundary layer conditions near the rim surface of the hub, and which may migrate to outboard regions of the blade, reducing lift and increasing drag. A flow regime may be a region of air having a localized pattern of movement distinct from air movement in adjacent regions. A flow regime may be a laminar flow over an airfoil, a vortex coming off of a wing tip, a boundary layer attached to a hard surface, a turbulent regime of air, such as on the suction side of a wing in stall, or a mix of these individual flow regimes. Boundary layers may be regions of shearing between the molecules of air attached to a hard surface and the air that is further away, giving rise to various flow regimes having turbulence, vortices, or other movement patterns. In contrast, the working portion of the fan blade may generate propulsion and an associated low pressure zone due to a laminar flow across the suction and pressure sides of the blade. Because inboard flow regimes near the rim surface may have differing airflow and higher pressures than the laminar flow generating propulsion, they may migrate outboard along the blade and substantially reduce propulsion.

Conventional turbofan designs may utilize various methods to compensate for inboard flow regimes in the fan, such as rounding the root of the blade so it does not attempt to generate lift, or using long blades to place the working portion of the blade further away from the rim surface, thereby forfeiting fan efficiency. However, while sacrificing efficiency may be acceptable in a design allowing higher fuel consumption and higher manufacturing cost, it may not be acceptable in a solution requiring economy. Particular inboard flow regimes that reduce fan efficiency may include those arising from the boundary layers associated with the rim surface, the air inlet adjacent to the rim surface, and the wing-body corner line between the hub and the root of the blade.

Another problem in the art may be the lack of a lightweight, composite rotor of simple manufacture. An integrally bladed composite rotor like that disclosed in U.S. Pat. No. 7,491,032 may form blades at each blade location during circumferential winding of a hub with a continuous filament, creating a lightweight one piece assembly. Unfortunately, the disclosure requires cornering of the filaments from a circumferential to a radial path to form each blade, then back again to a circumferential path, which may require a complex manufacture and tension control. Also, blade shaping options may be fewer in such an integrated rotor formation since any sweep, twist, thickness, and taper that is required needs to be integrated into one winding process, which may restrict the features and parameter ranges can be implemented. Additionally, the disclosure of an integrally bladed rotor may not allow for the insertion of a simple preformed blade into a hub being wound.

Another example of a composite rotor is the composite turbine described in U.S. Pat. No. 4,354,804. The hub disclosed in '804 may be formed of carbon cloth and reinforcing carbon filaments, and the blade may be formed of chopped carbon fibers with radial reinforcing, all fabricated at the same time. Unfortunately, complex shaping of blade and hub are combined into one process that may be expensive and a difficult one in which to control tolerances. In another disclosure, a composite flywheel disclosed by U.S. Pat. No. 4,187,738 uses continuous filaments coated with a binding agent to layer concentric toroids, each layer being individually cured before adding the next layer. However, layering and then curing successive toroids of composite material may require a long manufacturing process. Additionally, the process disclosed in '738 may require that the filaments be highly prestressed in order to resist the large centrifugal forces present in a flywheel rotating at speeds in excess of 35,000 rpm. Unfortunately, prestressing may be an expensive and unnecessary manufacturing constraint for a lower-speed fan hub. For example, a fan comprised of low-stress filament may be adequately strong for speeds of less than approximately 14,000 revolutions per minute (rpm). Additionally, rotor speeds of less than 14,000 rpm may allow grease bearings to be used instead of complicated oil lubrication. In summary, the prior art may lack a method for manufacturing a lightweight composite rotor of modest centrifugal strength using preformed blades and using simple manufacturing techniques.

As can be seen, there exists a need in the art for a more efficient and lightweight ducted fan, preferably driven by a reciprocating engine, and optimized for high subsonic flight. Furthermore, there exists a need in the art for an all-supersonic rotor that eliminates transonic turbulence and simplifies blade shaping. Additionally, there exists a need in the art for methods to manage inboard flow regimes that reduce fan efficiency. Also, there exists a need in the art for a composite hub comprised of low-stress filaments into which thin, preformed blades may be adhesively retained, forming a one-piece rotor. Finally, there exists a need in the art for a composite rotor formed of non-exotic materials and that can be fabricated using simple processes and without expensive machining or tooling.

BRIEF SUMMARY

The above-noted needs associated with supersonic fans are specifically addressed and alleviated by the present disclosure that, in an embodiment, provides a supersonic fan that may comprise a hub having a rim surface and rotating. At least two fan blades may extend radially from the rim surface of a hub. Each fan blade may have an inboard leading edge of an inboard length rotating at an airspeed of at least approximately Mach 1 and swept at an inboard sweep angle with respect to a radial of the hub. A duct may circumscribe the fan blades. A low-pressure zone along each fan blade may generate propulsion. An inboard flow regime forming near the rim surface may migrate along the fan blades toward the duct and contaminate the low-pressure zone, thereby reducing propulsion. An outboard leading edge may have an outboard length that is greater than the inboard length and which is swept at an outboard sweep angle. The outboard leading edge may extend approximately radially from the inboard leading edge and form an apex therebetween. The inboard and outboard sweep angles may each be at least approximately 30 degrees and in opposite directions. An inboard vortex may form near to and as a result of the apex and trail circumferentially across the fan blades. The inboard vortex may be positioned to substantially confine the inboard flow regime to be inboard of the apex, thereby preserving the low-pressure zone and increasing propulsion for the supersonic fan.

Also disclosed is a supersonic fan that may comprise a hub having a hub volume defined by an inner circumferential surface, two adjoining parallel side surfaces perpendicular to the inner circumferential surface, and a rim surface. The rim surface may have a rim width and a rim radius defining a plane of rotation. At least one continuous filament may wind spirally, substantially within the plane of rotation, and may be surrounded by a cured binder having a binder volume. The continuous filament may have a filament inner end terminating near the inner circumferential surface and a filament outer end terminating near the rim radius. The continuous filament may array laterally between the two side surfaces and layer radially out to the rim surface, forming a hub. A ratio of the binder volume to the hub volume may range from approximately 20 percent to approximately 65 percent. At least two fan blades may each have at least one mounting finger substantially parallel to the plane of rotation and buried beneath the rim surface. Each fan blade may have a working portion extending above the rim surface to a tip radius. The mounting finger may have a finger thickness, where a ratio of the finger thickness to the rim width may be less than approximately 25 percent of a ratio of the binder volume to the hub volume. The cured binder may bind the fan blades to the hub, forming the supersonic fan in one piece. A ratio of the rim radius to the tip radius may be at least approximately 0.65, creating a substantially uniform speed along the outboard leading edge. The continuous filament may substantially provide the tensile strength resisting the centrifugal and circumferential forces within the hub.

Also disclosed is a method for providing a supersonic fan, which may include the step of pultruding at least one continuous filament through a bath of uncured binder, thereby forming a coated filament. The method may further include the step of winding the coated filament spirally into a hub shaped substantially as a disk with a rim surface, a rim width, and a rim radius defining a plane of rotation. The method may further include the step of embedding at least 2 fan blades into the rim surface where the fan blades each have a working portion and at least one mounting finger. The mounting finger may have a finger thickness and be substantially parallel to and adhere between adjacent windings of the coated filament. The mounting finger may displace a part of the uncured binder, where the finger thickness may be less than approximately 15 percent of the rim width. The working portion may be located opposite the mounting finger and extend above the rim radius to a tip radius, wherein the working portion generates propulsion. The method may further include the step of curing the hub. The method may further include the step of circumscribing the fan blades with a duct. The method may further include the step of dividing the working portion into an inboard length and an outboard length, the inboard length corresponding to an inboard leading edge rotating at an airspeed of at least approximately Mach 1. An inboard flow regime forming near the rim surface may migrate outboard over the working portion, thereby reducing propulsion. The method may further include the step of sweeping an outboard leading edge backward from an apex formed between the inboard leading edge and the outboard leading edge, the outboard leading edge corresponding to the outboard length. The outboard leading edge may be swept at an outboard sweep angle with respect to a radial of the hub, and the inboard leading edge may be swept forward at an inboard sweep angle. The outboard length may be greater than the inboard length. The difference between the outboard sweep angle and the inboard sweep angle may be at least approximately 60 degrees. The method may further include the step of confining the inboard flow regime to remain substantially inboard of the apex, wherein an inboard vortex generating near to and as a result of the apex and trailing circumferentially across the rotating fan blades substantially prevents the migration of the inboard flow regime and thereby increases propulsion for the supersonic fan. The method may further include the step of limiting a ratio of the rim radius to the tip radius to be at least approximately 0.65, creating a substantially uniform speed across the outboard leading edge and producing the supersonic fan in one piece rotating in the plane of rotation and circumscribed by the duct.

The features, functions and advantages that have been discussed can be achieved independently in various embodiments of the present disclosure or may be combined in yet other embodiments, further details of which can be seen with reference to the following description and drawings below.

BRIEF DESCRIPTION OF THE DRAWINGS

These and other features of the present disclosure will become more apparent upon reference to the drawings wherein like numbers refer to like parts throughout and wherein.

DETAILED DESCRIPTION

Figure 1B:
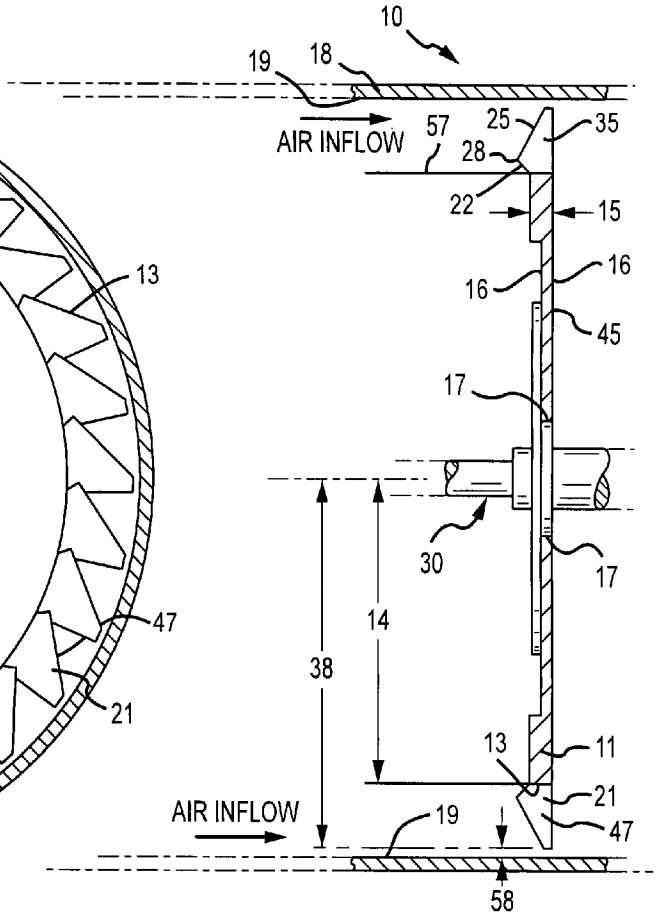
FIG. 1B is a side sectional view of the supersonic fan of FIG. 1A.
Figure 1A:
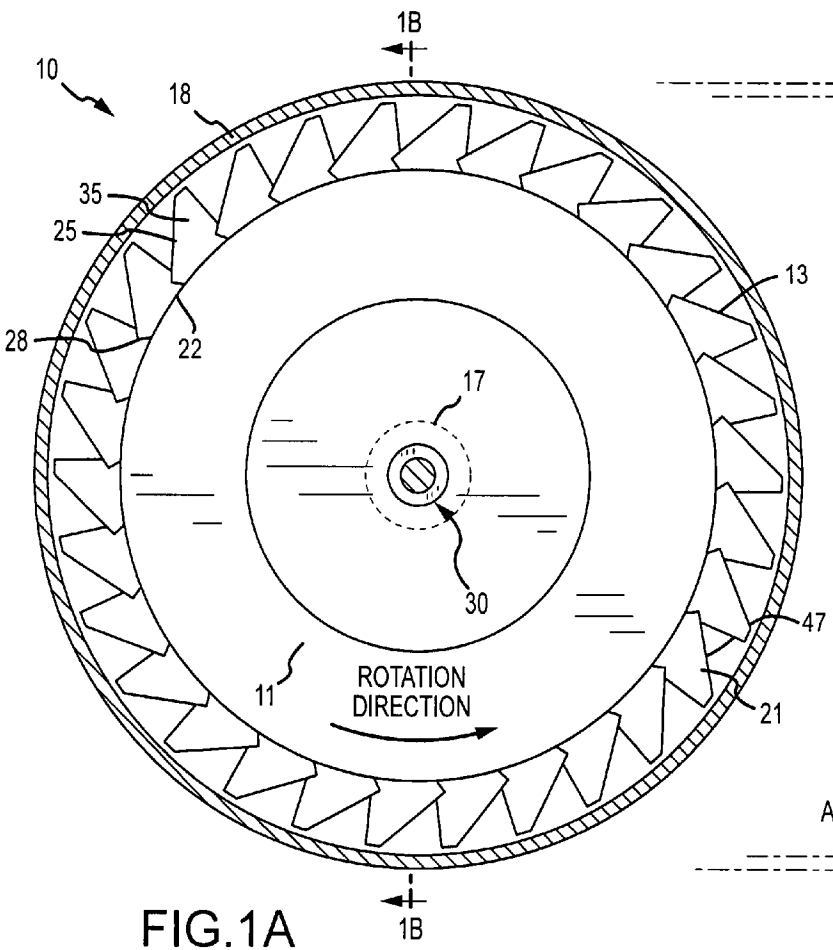
FIG. 1A is a front view of an embodiment of a supersonic fan circumscribed by a duct.

Referring now to the drawings wherein the showings are for purposes of illustrating various aspects of the present disclosure, shown in FIG. 1A is an embodiment of a supersonic fan 10 which may comprise hub 11 having an inner circumferential surface 17 and attaching to fan blades 21.

Extending out from rim surface 13 may be the working portion 47 of fan blade 21. Duct 18 may circumscribe fan blades 21 that have an outboard leading edge 25, an inboard leading edge 22, and an apex 28 configured to establish an improved fan efficiency in the presence of inboard flow regimes (not shown). Blade suction side 35 is visible in this front view of supersonic fan 10 and may be associated with a low pressure zone (not shown) along the length of fan blade 21.

Referring to FIG. 1B, in an embodiment, duct clearance 58 (exaggerated) may separate a tip of fan blade 21 from inner duct surface 19 of duct 18 by less than approximately 0.010 inch. More typically, duct clearance 58 may be between approximately 0.001 inch and 0.005 inch. Since fan drag may decrease approximately 1 percent for each 0.001 inch decrease in duct clearance, it may be desirable to minimize duct clearance. Hub 11 may extend from inner circumferential surface 17 to rim surface 13 and attach to fan blade 21 having a working portion 47 extending above rim surface 13. Blade suction side 35 may be the low pressure side of the airfoil of working portion 47. Air inlet surface 57 and inner duct surface 19 may form a channel that guides air into fan blades 21 rotating within plane of rotation 45. Rim width 15 may be approximately the same as the width of fan blades 21 in order to minimize the weight of hub 11 while providing for a full-width attachment to fan blades 21. Rim width 15 may be established by side surfaces 16 and may thin to form a hollow cavity across the central region of hub 11, accommodating the attachment of axle mount 30 to hub 11. In an embodiment not shown, rim width 15 may instead be of uniform width all the way to inner circumferential surface 17. While the shape of hub 11 may be substantially that of a disk, it is to be understood that variations are allowed to meet design objectives that include weight, cost, mechanical balance, and other parameters known in the art. In an embodiment, rim width 15 may be approximately 1.125 inch and tip radius 38 may be approximately 14 inches.

Continuing with FIG. 1B, supersonic fan 10 may have a high hub-to-tip ratio (HTR), defined by a ratio of rim radius 14 to tip radius 38, for the purpose of minimizing the speed differential between a root and a tip of fan blade 21. A benefit of using a high HTR may be to construct a supersonic fan 10 whose blade speed is supersonic and substantially uniform across inboard leading edge 22, apex 28, and outboard leading edge 25, allowing for a relatively fixed blade twist angle (not shown) in order to set an angle of attack (AOA, not shown). Another result of a high HTR may be the elimination of transonic zones (not shown), which may thereby permit simpler blade shaping and allow for thinner, lighter blades. A further benefit of the high HTR disclosed herein is that a substantially uniform blade speed may enable a leading edge sweepback that is substantially fixed and not progressively curved, further simplifying blade shaping. The hub-to-tip ratio of rim radius 14 to tip radius 38 may be relatively high and greater than approximately 0.65, thereby facilitating lightweight, non-fluttering fan blades and a substantially uniform blade speed that is all-supersonic. For example, an HTR of 0.65 may correspond approximately to a 1.5:1 differential in blade speed between the root and the tip of fan blade 21, thereby allowing for a substantially uniform leading edge sweepback. Preferably, the HTR may be approximately 0.8 and correspond to a 1.25:1 differential in blade speed. The simpler and lighter blade disclosed above may enable simple manufacture of a lightweight composite rotor having increased fan efficiency. Aerodynamic parameters of fan blade 21 and additional benefits of a high HTR will be discussed below.

Figure 2C:
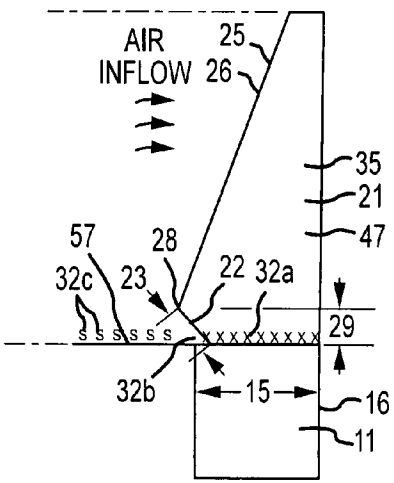
FIG. 2C is a detailed side sectional view of the supersonic fan of FIG. 2A showing the fan blade and the hub.
Figure 2A:
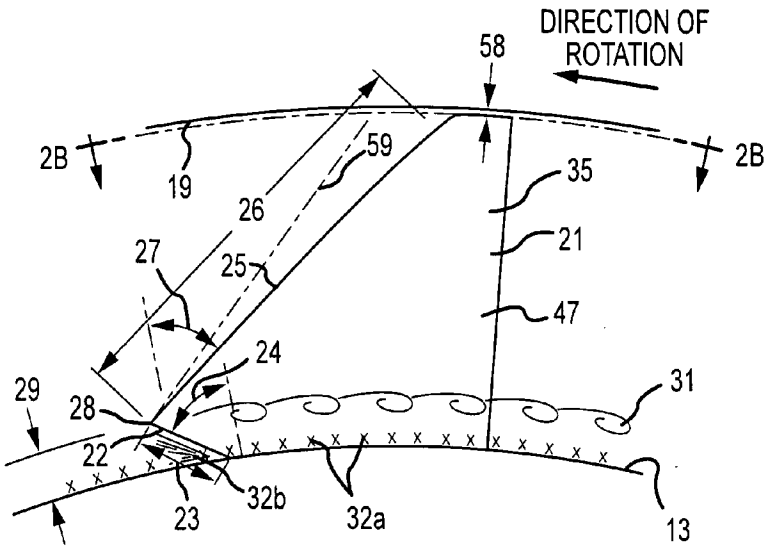
FIG. 2A is a detailed front view of an embodiment of a supersonic fan showing aerodynamic parameters of a fan blade mounted to a hub.
Figure 2B:
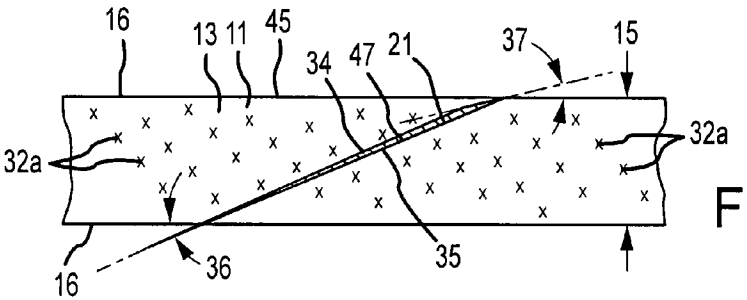
FIG. 2B is a detailed top sectional view of the supersonic fan of FIG. 2A showing the fan blade and the hub from the blade tip.

Referring to FIGS. 2A, 2B, and 2C, shown is an embodiment of a fan blade 21 whose inboard leading edge 22 of inboard length 23 and inboard sweep angle 24 may be rotating at an airspeed of at least approximately Mach 1. Working portion 47 may be the entire visible part of fan blade 21 attached to hub 11. Working portion 47 may be circumscribed by inner duct surface 19 with a duct clearance 58. Outboard leading edge 25 may have outboard length 26 at an outboard sweep angle 27 swept to be behind forward shock wave 59 in order to maximize fan efficiency. In another embodiment, the outboard sweep angle 27 may range from approximately 30 degrees to approximately 70 degrees. In another embodiment where the outboard leading edge 25 operates at a speed of between approximately Mach 1.1 and approximately Mach 1.4, the forward shock wave 59 may occur at an angle of approximately 45 degrees, and outboard sweep angle 27 may therefore be preferably set to approximately 50 degrees, thereby minimizing supersonic flow regimes that may reduce fan efficiency.

Blade suction side 35 and blade pressure side 34 may form the two sides of an airfoil generating propulsion as a result of a substantially laminar flow with a positive, non-stalling AOA. The laminar flow may also generate a low pressure zone (not shown) proximate to blade suction side 35 and facilitating propulsion. Inboard leading edge 22 and outboard leading edge 25 may be sharpened or thinned to minimize the drag due to supersonic shock formation. For example, the leading edges may be thinned to approximately 0.004 inches. Additionally, the trailing edges (not shown) may be thinned to approximately 0.004 inches to minimize drag.

Continuing with FIGS. 2A, 2B, and 2C, in an embodiment, an inboard flow regime may form proximate to the rim surface 13 due to boundary layer conditions, and which may comprise rim flow regime 32*a*, wing-body flow regime 32*b*, and inlet flow regime 32*c*. The inboard flow regimes may migrate out along fan blade 21 and contaminate the low pressure zone associated with blade suction side 35, thereby substantially reducing propulsion, measurable as fan efficiency. Reductions in fan efficiency may manifest as lower thrust, as higher drag on the drive shaft (not shown), or both. Shown in FIGS. 2A and 2B, rim flow regime 32*a* may refer to a region of air attached to and rotating with rim surface 13, while the relative airflow slightly outboard of the rim surface will have an axial component due to aircraft velocity, creating a shearing effect near the rim surface 13. Shown in FIGS. 2A and 2C, wing-body flow regime 32*b* may occur in the corner between the root of the exposed fan blade 21 and rim surface 13, and may cause turbulence that migrates out along the blade and reduces fan efficiency. The thickness of inboard flow regime may be less than approximately 0.25 inch.

Referring to FIG. 2C, rim width 15 may adjoin two side surfaces 16. Inlet flow regime 32*c* may refer to a region of air along air inlet surface 57 which may meet closely with and be parallel to rim surface 13. Air molecules close to inlet surface 57 may lack the full axial component associated with aircraft velocity and be in shear with regions of air slightly above air inlet surface 57. Also, inlet flow regime 32*c* having an axial component may meet rim flow regime 32*a* having a radial component and form another shearing boundary therein. In addition, other inboard flow regimes may form in various embodiments and reduce fan efficiency unless mitigated.

Referring now to FIG. 2A, in an embodiment, an apex 28 may be formed between inboard leading edge 22 and outboard leading edge 25, creating a delta planform offset from the rim surface 13 by an apex offset 29. Outboard sweep angle 27 and inboard sweep angle 24 may preferably each be approximately 50 degrees and in the opposite direction from each other, thereby generating a vortex 31 trailing circumferentially (chordwise) from the apex 28. In an embodiment, inboard leading edge 22 may be swept forward from the rim and outboard leading edge 25 may be swept backward. Vortex 31, at certain design angles of attack, may act as a fence and substantially confine the inboard flow regime to remain inboard of apex 28, thereby preventing contamination of the low pressure zone (not shown) and increasing fan efficiency. In another embodiment, outboard sweep angle 27 and inboard sweep angle 24 may each range from approximately 30 degrees to approximately 70 degrees and sweep in the opposite direction from each other. By choosing sweep angles that keep outboard leading edge 25 behind forward shock wave 59, and by establishing an offset delta planform with an apex 28, a resulting vortex 31 may substantially prevent inboard flow regimes 32*a*, 32*b*, and 32*c* from disturbing the laminar flow across working portion 47, thereby increasing fan efficiency. In this way, the apex 28 is positioned so that resulting vortex 31 confines inboard flow regimes while retaining a maximum area for fan blades 21 generating a maximum thrust.

Continuing with FIG. 2A, outboard length 26 may be greater than inboard length 23 in order to reserve the greater share of the area of fan blade 21 for propulsion undisturbed by the inboard flow regimes. For example, when inboard and outboard lengths are approximately equal, the outboard region of fan blades 21 may correspond to approximately $1-(\frac{1}{2})^2$, or 75% of the available area, allocating most of the fan area to propulsion undisturbed by inboard flow regimes. In an embodiment, outboard length 26 may preferably be at least three times inboard length 23. Apex offset 29 may be greater than approximately 0.25 inch and less than approximately one-half the distance between the rim surface 13 and inner duct surface 19. The minimum value of 0.25 inch for apex offset 29 may place vortex 31 outside of the inboard flow regimes and thus substantially contain them. In an embodiment, apex offset 29 may preferably be approximately 0.5 inch. In an embodiment, outboard leading edge 25 may have a backward sweep and inboard leading edge 22 may have a forward sweep. Alternately, any combination of inboard sweep angle 24 and outboard sweep angle 27 may be chosen that forms an apex 28 that maximizes fan efficiency.

Referring to FIG. 2B, in an embodiment, a chord of working portion 47 may be twisted by a blade twist angle 36 that is constant with respect to plane of rotation 45 in order to set a positive and non-stalling angle of attack (AOA) along inboard leading edge 22 and outboard leading edge 25. Blade twist angle 36 may also be known in the art as the angle of incidence. Because of the higher speed experienced by the outboard region of working portion 47, tip twist angle 37 may rotate the chord of the outboard region of fan blade 21 to be more parallel to plane of rotation 45. In an embodiment, blade twist angle 36 may be preferably set to approximately 24 degrees in order to accommodate a relative airflow (not shown) of approximately 18-20 degrees under design conditions. In an embodiment, tip twist angle 37 may be preferably set to approximately 19 degrees in order to accommodate a relative airflow (not shown) of approximately 13-19 degrees. The angle of relative airflow impinging on working portion 47 may vary with blade velocity and axial (aircraft) velocity according to a vector sum thereof under design conditions. For example, in an embodiment, design conditions may provide for a minimum aircraft speed of approximately 350 mph and a maximum aircraft speed of approximately 550 mph. In another embodiment, design conditions may preferably provide for a minimum aircraft speed of approximately 400 mph and a maximum aircraft speed of approximately 475 mph.

Continuing with FIG. 2B, in an embodiment, blade speed may vary from approximately Mach 1.1 near the near the rim surface 13 to approximately Mach 1.7 near inner duct surface 19. In another embodiment, blade speed may preferably vary from approximately Mach 1.1 near the near the rim surface 13 to approximately Mach 1.4 near inner duct surface 19. In an embodiment not shown, working portion 47 may be twisted by a blade twist angle 36 that is helical in progression, thereby tracking a progressive angle of relative airflow and maintaining an approximately constant AOA from rim surface 13 to inner duct surface 19. It is to be understood that other curved progressions or steps of blade twisting are possible in order to optimize fan efficiency for design conditions and simplify manufacturing processes. For example, fan blade 21 may have an exponential blade twist progression. Fan blades 21 may be pre-formed and comprised of one or more of the following materials: metal, carbon composite, molded composite, laminate composite, ceramic, plastic.

Continuing, rim width 15 may span the distance between the two side surfaces 16 of hub 11 and, in an embodiment, may approximately match the width of fan blade 21 rotated to blade twist angle 36. The design AOA may be varied through the related effects of fan rotation speed, axial air speed, and a convergence-divergence nozzle (not shown). In an embodiment, the design value for AOA may range from approximately 20 degrees to less than approximately 0 degrees.

In summary, FIGS. 2A, 2B, and 2C may illustrate a fan blade 21 having a delta planform with an apex 28 offset by apex offset 29, and having a blade twist angle 36 and tip twist angle 37, thereby establishing an all-supersonic fan with improved efficiency under design conditions. Under take-off conditions, when axial airflow may be lower and blade angle of attack higher, at design RPM, the inboard region of the blade may be supersonic. In an embodiment, fan blades 21 may be optimized for a relative blade speed of between approximately Mach 1.1 and approximately Mach 1.4.

Figure 3:
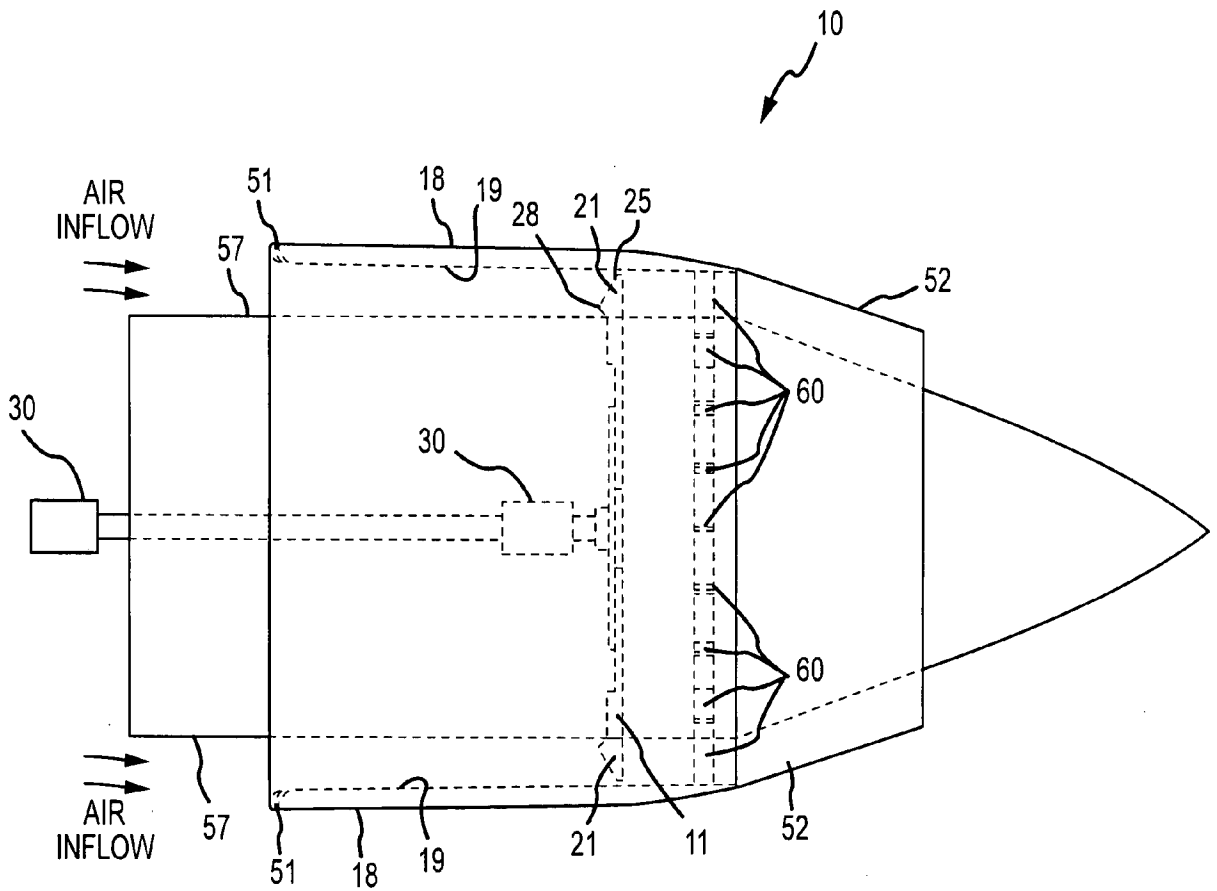
FIG. 3 is a side view of an embodiment of a supersonic fan and duct assembly showing air inlet slats, stator blades, and a convergence-divergence nozzle.

Referring to FIG. 3, in an embodiment, fan blades 21 attaching to hub 11 may form a supersonic fan 10 having a high hub-to-tip ratio (not shown). Axial airflow may enter the channel formed by inner duct surface 19 and air inlet surface 57 and may become turbulent due to a forward edge of duct 18. Air inlet slat 51 may be positioned circumferentially along the forward edge of duct 18, presenting a front lip that is radially shaped in order to reduce turbulence and improve fan efficiency. Air inlet slat 51 may form a radial gap (not shown) along the forward edge of duct 18 in order that air slightly outside of the duct's perimeter can be drawn into duct 18, effectively increasing the area of the air inlet and improving fan efficiency. The radial gap (not shown) may be open at lower aircraft speeds and closed at higher aircraft speeds. Air inlet slat 51 may be a Handley-Page slat, or a slat design similar to Handley-Page slats. In an embodiment not shown, air inlet slat 51 may comprise double air inlet slats where two radial gaps draw air into duct 18.

In another embodiment not shown, air inlet slat 51 may be adjustable, closing or opening automatically in response to air pressure, or controlled manually. Slat 51 may be segmented into sections that can move independently of each other in response to yaw and other aircraft orientations that create variations in airflow along the circumference of duct 18. For example, slat 51 may divided into two 180 degree contiguous sections mounted to duct 18 and operated with differing degrees of closure or opening. It is to be noted that the term "slot" may be sometimes used in the literature in place of the word "slat", and both terms may refer to an airfoil-shaped member positioned in front of a forward edge.

Continuing with FIG. 3, apex 28 on fan blade 21 may confine inboard flow regimes to remain inboard of the apex 28, thereby improving fan efficiency. Aft of the fan blades may be positioned a convergence-divergence nozzle (CD nozzle) 52 which may be adjustable to adjust an outflow area (not shown) in order to optimize fan efficiency. The action of the CD nozzle 52 is to compensate for and adjust an AOA that varies with the aircraft speed and the rotational speed of fan blades 21. When the CD nozzle 52 is restricted, outflow area is reduced in order to reduce through flow at the fan, increase exhaust velocity and increase the AOA to remain optimum. When the CD nozzle 52 opening is increased, the opposite effect occurs. In an embodiment, the outflow area (not shown) may range from an increase of less than approximately 15 percent to a decrease of greater than approximately 50 percent.

Additionally, stator blades 60 may be positioned aft of the fan blades in order to remove the swirl caused by the rotating fan, and may be affixed to inner duct surface 19. Stator blades 60 may straighten and redirect the axial flow, increasing the thrust substantially. Combining an improved supersonic fan 10 with air inlet slat 51, CD nozzle 52 and stator blades 60, and integrating aircraft enhancements such as reduced weight, reduced drag, and carrying less fuel may enable an economical 2-4 passenger aircraft flying at high subsonic speeds to be driven by a fuel-economical, diesel or gasoline reciprocating engine having a high horsepower to weight ratio.

Figure 4A:
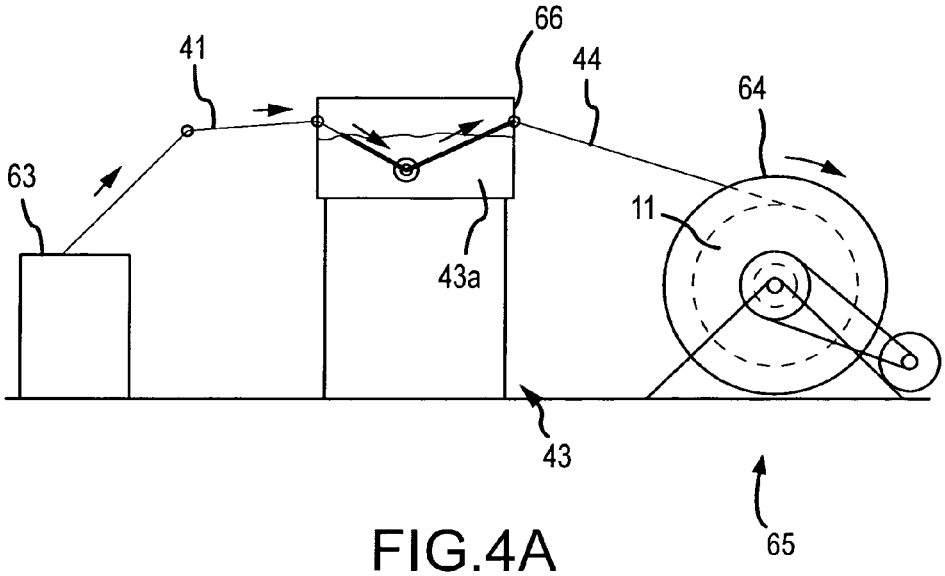
FIG. 4A is a front view of an embodiment of a method providing for a supersonic fan showing a spirally wound composite hub and a winding engine.
Figure 4B:
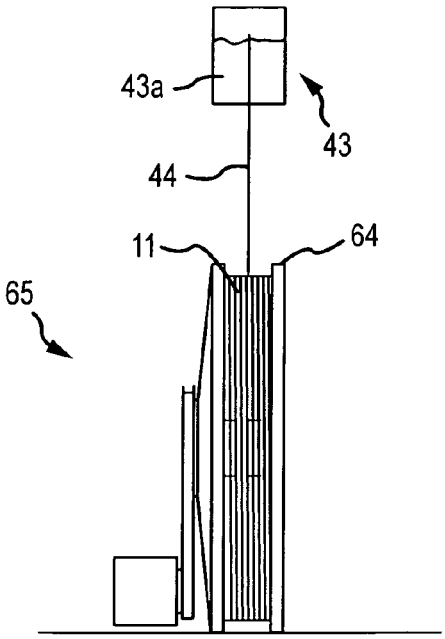
FIG. 4B is a side view of the method providing for a supersonic fan of FIG. 4A showing a spirally wound composite hub and a winding.

Referring to FIGS. 4A and 4B, in an embodiment, shown is a simple overview of a manufacturing process that may be used to form a composite rotor (not shown). One or more continuous filaments 41 may be drawn from filament spool 63 and pultruded by winding engine 65 through a bath of uncured binder 43 to produce coated filaments 44 and hub 11. Pultrusion ring 66 may ensure moderate tension on continuous filaments 41. Winding engine 65 and pultrusion ring 66 may ensure that coated filaments 44 layer onto winding spool 64 with an appropriate volume of binder volume (not shown), thereby adhering fan blades (not shown). Winding may continue until a spiral accumulation of coated filaments 41 reaches a rim of winding spool 64. The combination of an appropriate binder volume and moderate tension may ensure that continuous filaments 41 provide a centrifugal strength during rotation of the rotor. The continuous filament 41 may comprise one or more of the following: glass fiber, carbon fiber, polymer, metal, a plurality of non-woven fibers, unidirectional fabric, para-aramid fiber, ceramic fiber. Uncured binder 43*a* may comprise one or more of the following: epoxy resin, polyester, polymer. In an embodiment not shown, continuous filament 41 may comprise overlapping fibers bound together to form one spiral accretion from a central region outward to a rim of winding spool 64.

Figure 5B:
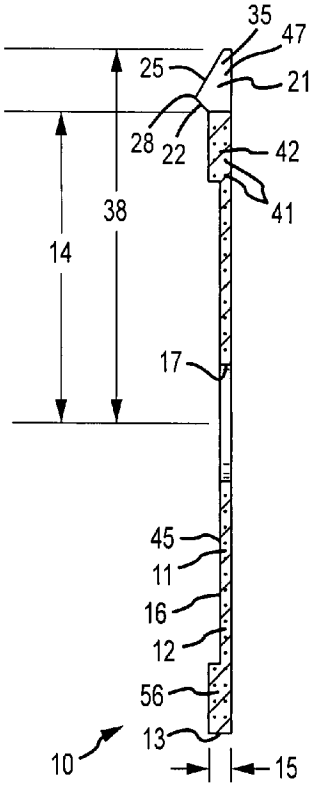
FIG. 5B is a side sectional view of the supersonic fan of FIG. 5A showing a binder and filaments.
Figure 5A:
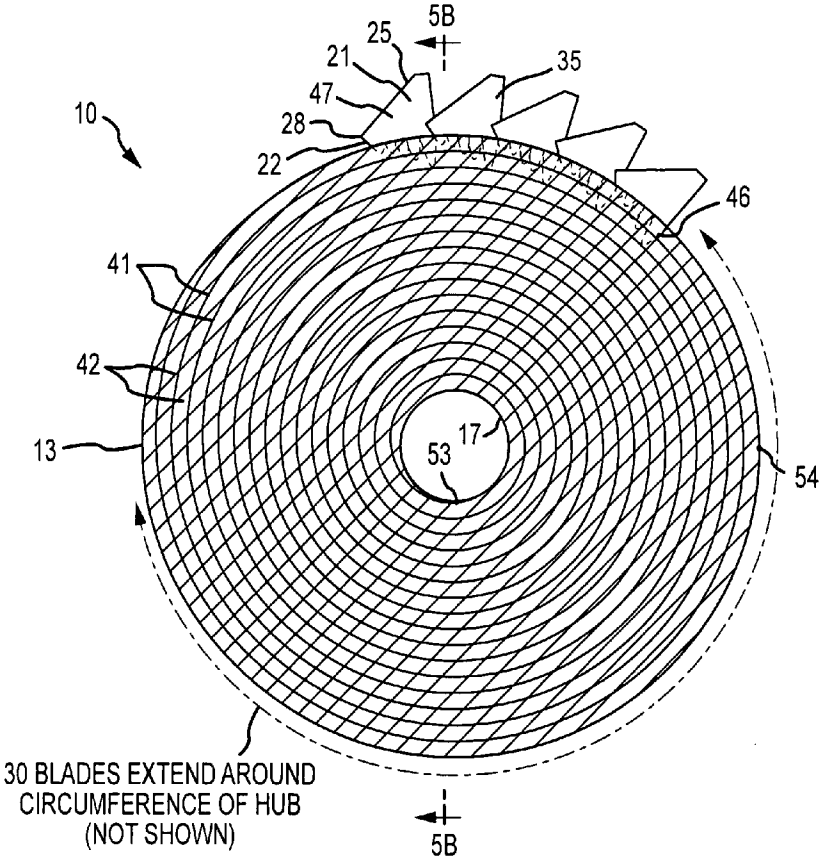
FIG. 5A is a front view of an embodiment of a supersonic fan showing a spirally wound composite hub with fan blades.

Referring to FIGS. 5A and 5B, in an embodiment of a composite supersonic fan 10, at least one or more continuous filaments 41 surrounded by cured binder 42 may wind spirally from inner circumferential surface 17 to rim surface 13, forming a hub 11 having hub volume 12. Continuous filament 41 may layer laterally within binder volume 56 and between side surfaces 16, and may layer radially to rim surface 13. Filament inner end 53 may be attached to inner circumferential surface 17, or terminate near enough to surface 17 to establish structural integrity for hub 11. Filament outer end 54 may be proximate to rim surface 13. For example, a piece of tape, a drilled hole, or other means may be employed to position filament inner end 53. A ratio of binder volume 56 to hub volume 12 may be set low enough so that there are sufficient number of filaments to provide good centrifugal strength; a ratio may be set high enough to allow adequate displacement volume for mounting fingers 46 embedded in hub 11. For example, a ratio of binder volume 56 to hub volume 12 may range from approximately 20 percent to approximately 65 percent. In an embodiment, a ratio of binder volume 56 to hub volume 12 may be approximately 50 percent.

Continuing, mounting fingers 46 of fan blades 21 may be embedded into hub 11, exposing working portion 47 having a blade suction side 35 and a width approximately equal to rim width 15. The fan blades 21 may be aligned for the desired blade twist angle 36 (not shown) prior to curing the composite hub. A ratio of rim radius 14 to tip radius 38 may be at least approximately 0.65 so that fan blades 21 have of a low aspect ratio and are of correspondingly low weight. In an embodiment, a ratio of rim radius 14 to tip radius 38 may be approximately 0.8. Outboard leading edge 25 may intersect inboard leading edge 22 at apex 28 and thereby establish a simple blade shaping that substantially confines inboard flow regimes (not shown) to remain inboard of apex 28, thereby increasing fan efficiency. The low aspect ratio of working portion 47 may allow fan blade 21 and mounting fingers 46 to be thin relative to rim width 15, thereby minimizing the displacement of cured binder 42 and continuous filaments 41 and preserving the centrifugal strength of hub 11. In an embodiment, the finger thickness (not shown) may be less than approximately 15 percent of rim width 15. In another embodiment, a ratio of finger thickness to rim width 15 may be less than approximately 25 percent of a ratio of the binder volume 56 to the hub volume 12. Filament outer end 54 may terminate close enough to rim surface 13 so that fan blade 21 is reliably retained during rotation of hub 11 within plane of rotation 45.

Continuing with FIGS. 5A and 5B, an array of fan blades 21 may populate the circumference of hub 11 and be arranged to balance dynamically during rotation within plane of rotation 45. In an embodiment, approximately 30 fan blades may be embedded in hub 11, providing propulsion during rotation. The orientation of spirally wound continuous filament 41 may cross somewhat during assembly and blade insertion, bending outside of a purely circumferential path due to small variations in winding tension and due to the insertion of a thin fan blade 21 which displaces cured binder 42. By providing sufficient binder volume 56 as a proportion of hub volume 12, by using multiple fingers 46, and by limiting finger thickness (not shown) accordingly, the displacement of continuous filament 41 during blade insertion may be minimized so as to preserve centrifugal strength, enabling a supersonic fan 10 of simple manufacture.

Fan blades 21 may be pre-formed and comprised of one or more of the following materials: metal, carbon composite, molded composite, laminate composite, ceramic, plastic. Fan blade 21 may be cast, cut, stamped, extruded, molded, or otherwise formed. In an embodiment, fan blade 21 may be formed of aluminum and have a length of approximately 3 inches. Low aspect ratio fan blades 21 may be reliably bonded to a composite hub 11 formed of cured binder 42 and at least one lightly tensioned continuous filament 41. However, the heavier weight of high aspect blades may not allow reliable adhesion by a composite hub below an HTR of less than approximately 0.65. HTR (hub-to-tip ratio) may be chosen to insure that fan blade 21 is all-supersonic under all aircraft conditions, including take-off, cruise, and unusual slow-flight conditions. The CD nozzle (not shown), engine rpm, and other factors may be adjusted to maintain all-supersonic conditions.

Figure 6A:
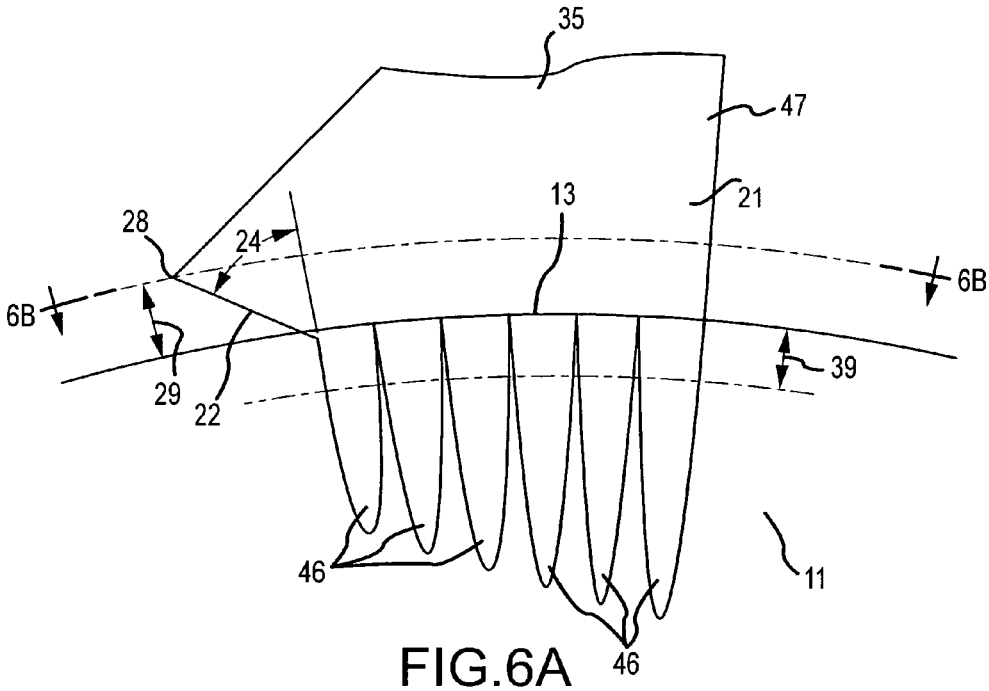
FIG. 6A is a detailed front cutaway view of an embodiment of a supersonic fan showing a fan blade mounted to a hub.
Figure 6B:
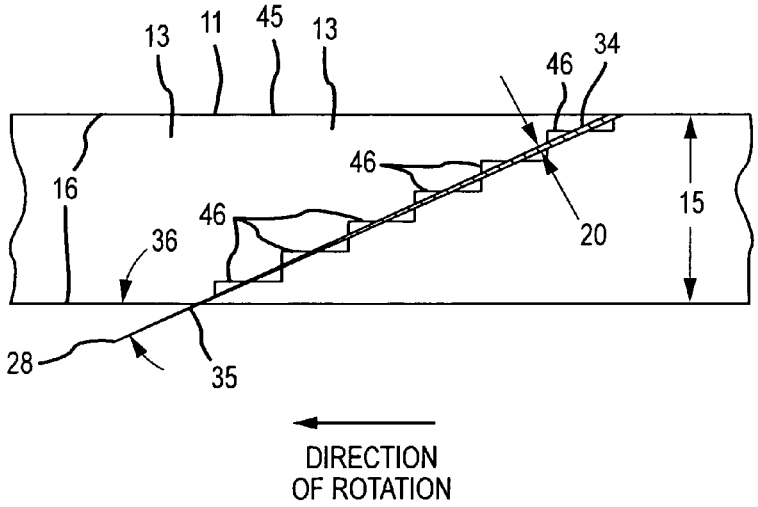
FIG. 6B is a detailed top sectional view of the supersonic fan of FIG. 6A showing the mounting fingers.

Referring to FIGS. 6A and 6B, in an embodiment, six non-overlapping mounting fingers 46 may embed into and adhere to hub 11 below rim surface 13. Fan blade 21 may be constructed of one piece of material having a blade thickness 20 approximately equal to finger thickness 48 (shown in FIG. 7B). Fan blade 21 may preferably be short (low aspect ratio) and made of a lightweight material such as aluminum or carbon composite in order to exert a small centrifugal force on hub 11, compared to a long blade made of denser material such as steel or titanium. In another embodiment (not shown), fan blade 21 may be thickened inboard of apex 28, including mounting fingers 46, in order to resist bending loads under extreme conditions. This thickening may be necessary in order to resist an axial airflow under flight conditions if the engine were to stop. For example, a one-piece fan blade 21 with thickened mounting fingers 46 may be fabricated out of a composite material. Alternatively, a doubler piece (not shown) mimicking the shape of the mounting fingers 46 and an inboard region of working portion 47 may be attached to the fan blade 21 to provide twice the mounting finger thickness for additional strength.

Continuing with FIGS. 6A and 6B, blade twist angle 36 may be set by twisting mounting fingers 46 within finger twist zone 39, positioning the mounting fingers 46 to be parallel to plane of rotation 45. By embedding mounting fingers 46 that are thin and non-overlapping, the displacement of continuous filaments 41 (not shown) and cured binder 42 (not shown) is minimal compared to rim width 15, thus preserving the radial strength of composite hub 11. In an embodiment, mounting fingers 46 may extend approximately 1.2 inch into hub 11, and twist zone 39 may be approximately 0.3 inch deep. Blade twist angle 36 may be approximately 24 degrees. Inboard leading edge 22 may be swept forward by inboard sweep angle 24 to meet apex 28 and create a delta planform offset from rim surface 13 by apex offset 29. Blade suction side 35 may face the oncoming axial airflow and may lie substantially between side surfaces 16. Blade pressure side 34 and blade suction side 35 may lie on opposite sides of fan blade 21.

Figure 7A:
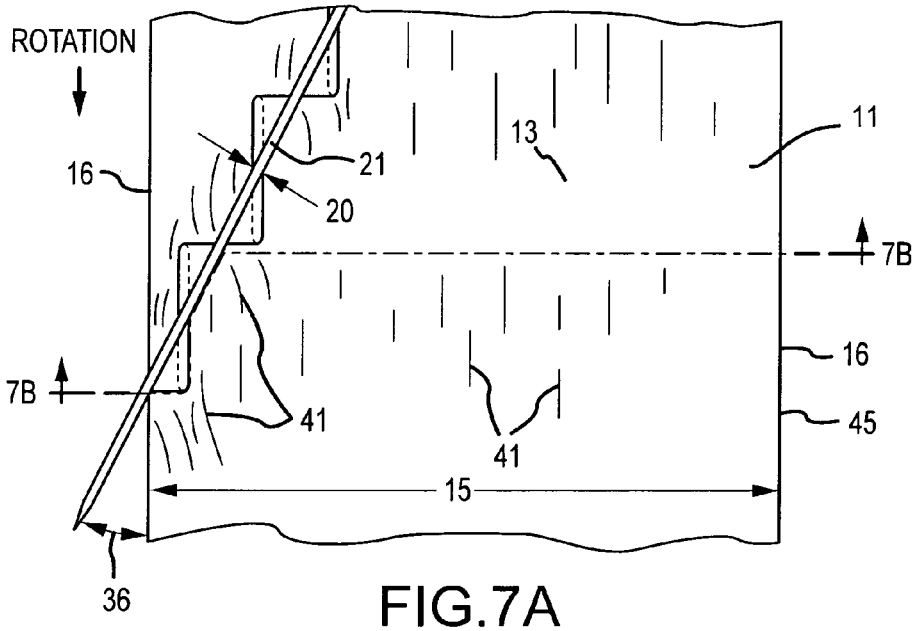
FIG. 7A is a detailed top sectional cutaway view of an embodiment of a supersonic fan showing the inboard region of the fan blade and the filaments.
Figure 7B:
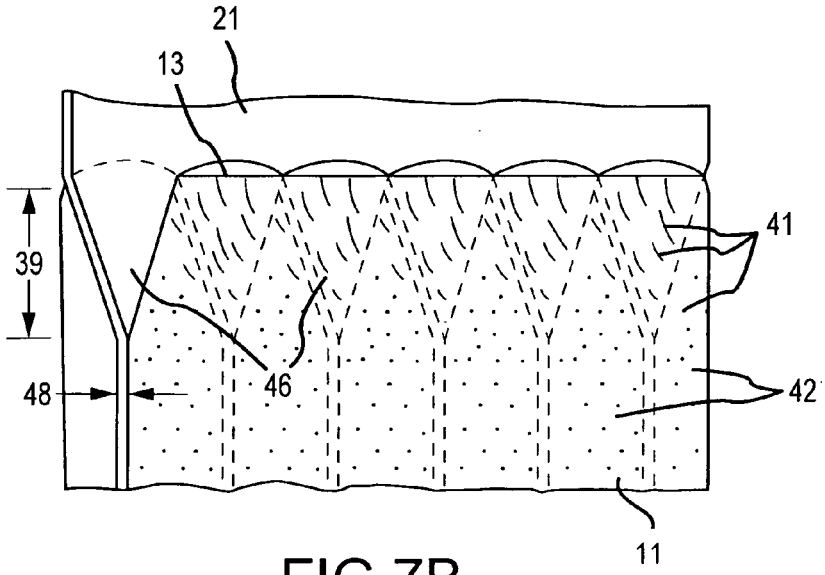
FIG. 7B is a detailed side sectional view of the supersonic fan of FIG. 7A showing the filaments and the finger twist zone fingers.

Referring now to FIGS. 7A and 7B, in an embodiment, mounting finger 46 may be parallel to the inboard region of fan blade 21 that is just above rim surface 13 and then twist by blade twist angle 36 to become parallel to side surfaces 16 below finger twist zone 39. In an embodiment, six mounting fingers 46 may be in a line and then twisted to form bonding surfaces that span rim width 15 in a non-overlapping relationship, thereby spreading the attachment load evenly across the width of hub 11. Rim width 15 may be wide enough to accommodate all the mounting fingers 46. In an embodiment, a ratio of finger thickness 48 to rim width 15 may be less than approximately 25 percent of a ratio of the binder volume 56 (not shown) to the hub volume 12 (not shown). For example, where a ratio of binder volume 56 to hub volume 12 may be approximately 50 percent, a ratio of finger thickness 48 to rim width 15 may be less than approximately $0.25\times0.50=12.5$ percent for secure attachment. In an embodiment, blade thickness 20 and finger thickness 48 may both be approximately 0.025 inch, whereas rim width 15 may be approximately 1.125 inch, so that a non-overlapping mounting finger 46 may displace only approximately 2.2 percent of the volume of hub 11 within a region where adhesion occurs. In an embodiment not shown, a doubler plate may double the thickness of mounting fingers 46 to be approximately 0.050 inch, corresponding to a 4.4 percent displacement of the volume of hub 11. In another embodiment (not shown), finger thickness 48 may range from approximately 0.020 inch to approximately 0.060 inch.

Continuing with FIGS. 7A and 7B, continuous filament 41 may curve around the mounting finger 46 when it is inserted into hub 11, moving slightly to the side or outward radially. Additionally, uncured binder 43*a* (not shown) may ooze to rim surface 13 where it may be smoothed into a fillet along the base of fan blade 21. Placing excessive curvature in continuous filament 41 may weaken the radial strength of hub 11 to below a level necessary to maintain integrity during rotation within plane of rotation 45. However, by limiting finger thickness 48, controlling binder volume 56, maintaining a high HTR, and staggering the mounting fingers 46 to be non-overlapping, the radial strength of hub 11 and its adhesion to fan blades 21 may be more than adequate for an all-supersonic fan (not shown). In a pull test on prototype fan blades, failure occurred at approximately 3 times the centrifugal force that would be experienced during supersonic rotation, the failure occurring in the blade itself, not in the attachment between the blade and hub. The shear strength of cured binder 42 and a surface area of mounting fingers 46 may be chosen to sufficiently retain fan blade 21 at a maximum operating rpm, this rpm setting the critical load.

Figure 8A:
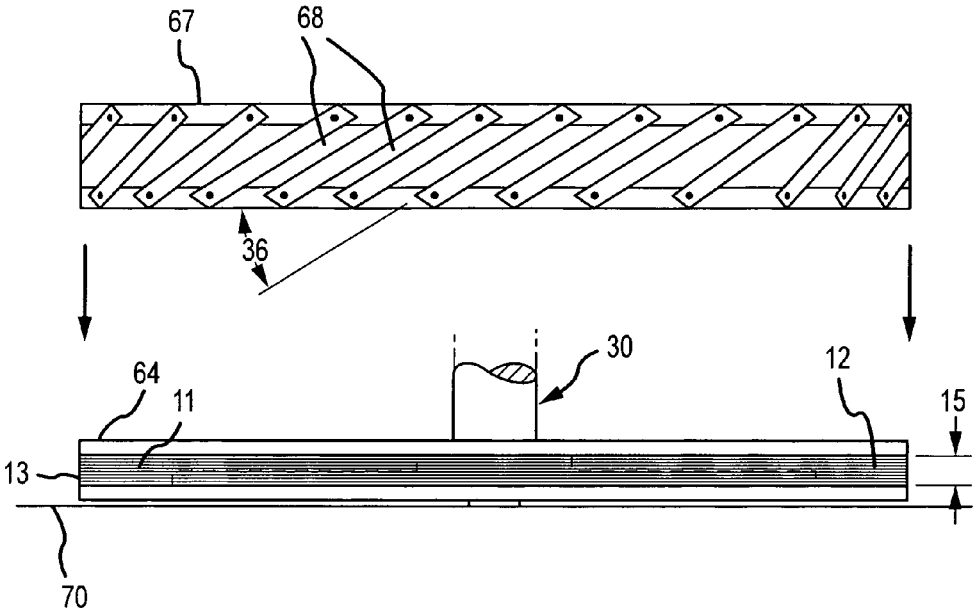
FIG. 8A is a side view of an embodiment of a method providing for a supersonic fan showing a blade insertion tool aligned with a spirally wound uncured hub and winding spool.
Figure 8B:
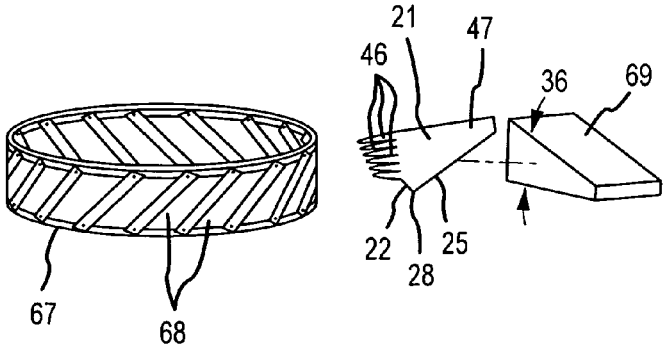
FIG. 8B is a perspective view of an embodiment of a method providing for a supersonic fan showing a blade insertion block aligning a fan blade to a blade insertion tool.

Referring to FIGS. 8A and 8B, in an embodiment, blade insertion tool 67 may be placed over uncured hub 11 and winding spool 64 in order to guide the placement of fan blades 21 into the rim surface 13. Blade insertion slots 68 are sized to receive mounting fingers 46 at blade twist angle 36 and guide a flush seating to rim surface 13. Additionally, blade insertion slots 68 may position fan blades 21 evenly across rim width 15. Blade insertion block 69 may be moved horizontally toward blade insertion tool 67 across assembly table 70 while fan blade 21 is held against the sloping surface of block 69, the sloping surface of block 69 being set at blade twist angle 36. Leading edges 22 and 25, intersecting at apex 28, may be positioned above rim surface 13, exposing working portion 47. In addition to setting blade twist angle 36, blade insertion block 69 may prevent fan blade 21 from drooping toward or away from assembly table 70. Additionally, in another embodiment (not shown), a ratcheting or other spacing-control mechanism built into or attached to assembly table 70 may be used to control the spacing between fan blades 21.

Once all fan blades 21 have been inserted, hub 11 may be cured by the application of heat, ultraviolet light, the passage of time, chemical catalyst, or any other curing means known in the art. Following curing, blade insertion tool 67 and winding spool 64 may be removed, and axle mount 30 may be attached to hub 11 for driving the composite rotor (not shown), followed by dynamically balancing the assembly. Rough edges may be removed and bearings or other hardware may be attached. In another embodiment not shown, preformed fan blades 21 may be aligned with and inserted into hub 11 using any tooling or methods available to one skilled in the art.

Additional modifications and improvements of the present disclosure may be apparent to those of ordinary skill in the art. Thus, the particular combination of parts described and illustrated herein is intended to represent only certain embodiments of the present disclosure and is not intended to serve as limitations of alternative embodiments or devices within the spirit and scope of the disclosure.

What is claimed is:

1. A supersonic fan, comprising:

a hub having a rim surface;

a rim radius defining the radius of the rim surface;

at least two fan blades extending radially from the rim surface to a tip radius of the fan blades, the fan blades being configured to generate a low-pressure zone along each fan blade for producing propulsion;

an inboard leading edge of the fan blade extending from the hub, the inboard leading edge having an inboard length and swept forward in a direction of hub rotation by an inboard sweep angle that is substantially constant;

an outboard leading edge extending approximately radially from the inboard leading edge and forming an apex therebetween, the outboard leading edge swept backward from the direction of hub rotation by an outboard sweep angle that is substantially constant from the apex to a blade tip, wherein the inboard and the outboard sweep angles are each between approximately 30 degrees and approximately 70 degrees, and where the apex is offset from the rim surface by greater than approximately 0.25 inch and by less than approximately 40% of a blade span spanning the rim surface to the blade tip;

a duct circumscribing the fan blades;

a ratio of the rim radius to the tip radius is at least approximately 0.65 for creating a substantially uniform and supersonic airspeed along the outboard leading edge and for enabling a lightweight blade without flutter; and the apex configured to form a vortex proximate the apex and trailing circumferentially across the fan blades from approximately the direction of hub rotation and substantially confining an inboard flow regime forming proximate to the rim surface to remain inboard of the apex, thereby preserving the low-pressure zone and increasing propulsion for the supersonic fan.

2. The supersonic fan of claim 1, wherein:

the outboard leading edge is positioned to be behind a forward shock wave.

3. The supersonic fan of claim 1, wherein:

the apex is offset from the rim surface by approximately 0.5 inch and the tip radius is approximately 14 inches.

4. The supersonic fan of claim 1, wherein:

each fan blade consists of at least one of the following: metal, carbon composite, molded composite, laminate composite, ceramic, plastic.

5. The supersonic fan of claim 1, further comprising:

a duct clearance between the duct and a tip of each fan blade, where the duct clearance is less than approximately 0.010 inch in order to minimize drag.

6. The supersonic fan of claim 1, further comprising:

at least one continuous filament surrounded by a cured binder and wound spirally to form the hub having a plane of rotation and a rim width;

wherein each fan blade has at least one mounting finger substantially parallel to the plane of rotation and buried adhesively beneath the rim surface, the mounting finger being buried prior to curing the cured binder; and wherein the mounting finger has a finger thickness of less than approximately 15 percent of the rim width, thereby forming the supersonic fan in one piece circumscribed by the duct.

7. The supersonic fan of claim 6, wherein:

the continuous filament consists of at least one of the following: glass fiber, carbon fiber, polymer, metal, a plurality of non-woven fibers, unidirectional fabric, para-aramid fiber, ceramic fiber.

8. The supersonic fan of claim 6, wherein:

the cured binder consists of at least one of the following: epoxy resin, polyester, polymer.

9. The supersonic fan of claim 6, wherein:

a chord of each fan blade is twisted out of the plane of rotation by a blade twist angle approximately about a radial of the hub and within a finger twist zone substantially below the rim surface, the blade twist angle setting an angle of attack.

10. The supersonic fan of claim 1, further comprising:

one or more air inlet slats positioned circumferentially along a forward edge of the duct, where a front lip of each slat is radially shaped.

11. The supersonic fan of claim 1, further comprising:

a convergence-divergence nozzle aft of the fan blades, the convergence-divergence nozzle optimizing an angle of attack for the fan blades.

12. The supersonic fan of claim 1, further comprising:

an array of stator blades aft of the fan blades, the array of stator blades straightening and redirecting an axial flow.

13. A supersonic fan, comprising:

a hub having a hub volume defined by an inner circumferential surface perpendicularly adjoining two parallel side surfaces and extending approximately radially to a rim surface having a rim radius and a rim width, the rim radius defining a plane of rotation;

at least one continuous filament surrounded by a cured binder having a binder volume, the continuous filament having a filament inner end and a filament outer end, the filament inner end terminating proximate to the inner circumferential surface, the continuous filament spirally wound substantially within the plane of rotation to array laterally between the two side surfaces and to layer radially out to the rim surface where the filament outer end proximately terminates, thereby forming the hub, wherein a ratio of the binder volume to the hub volume is between approximately 20 percent and approximately 65 percent;

at least two fan blades each having a working portion including an inboard leading edge and an outboard leading edge, and including at least one mounting finger having a finger thickness, the mounting finger being substantially parallel to the plane of rotation and buried beneath the rim surface, the working portion extending above the rim surface to a tip radius, and where a ratio of the finger thickness to the rim width is less than approximately 25 percent of a ratio of the binder volume to the hub volume; and the outboard leading edge of each of the at least two fan blades being swept backward from a direction of hub rotation by an outboard sweep angle that is substantially constant out to a blade tip starting at a radial location of less than approximately 40% of a blade span spanning the rim surface to the blade tip, wherein an inboard sweep angle of the inboard leading edge and the outboard sweep angle of the outboard leading edge are each between approximately 30 degrees and approximately 70 degrees; and wherein the cured binder binds the fan blades to the hub for forming the supersonic fan in one piece, where a ratio of the rim radius to the tip radius is at least approximately 0.65 for creating a substantially uniform and supersonic airspeed along the outboard leading edge and for enabling a lightweight blade without flutter, and where the continuous filament provides substantially for a tensile strength resisting centrifugal forces within the hub.

14. The supersonic fan of claim 13, wherein:

the continuous filament consists of at least one of the following: glass fiber, carbon fiber, polymer, metal, a plurality of non-woven fibers, unidirectional fabric, para-aramid fiber, ceramic fiber.

15. The supersonic fan of claim 13, wherein:

the cured binder consists of at least one of the following: epoxy resin, polyester, polymer.

16. The supersonic fan of claim 13, wherein:

each fan blade consists of at least one of the following: metal, carbon composite, molded composite, laminate composite, ceramic, plastic.

17. The supersonic fan of claim 13, wherein:

each fan blade contains approximately 6 mounting fingers arranged to be non-overlapping within the rim width.

18. The supersonic fan of claim 13, wherein:

the finger thickness ranges from approximately 0.020 inch to approximately 0.060 inch for resisting bending loads.

19. The supersonic fan of claim 13, wherein:

a chord of each fan blade is twisted out of the plane of rotation by a blade twist angle approximately about a radial of the hub and within a finger twist zone substantially below the rim surface, the blade twist angle setting an angle of attack.

20. The supersonic fan of claim 13, further comprising:

a duct circumscribing the fan blades.

21. A method providing for a supersonic fan, comprising:

pultruding at least one continuous filament through a bath of an uncured binder, the continuous filament being thereby coated and forming a coated filament;

winding the coated filament spirally into a hub, the hub being shaped substantially as a disk having a plane of rotation, a rim surface, a rim radius and a rim width;

embedding at least 2 fan blades into the rim surface, the fan blade having a working portion and at least one mounting finger having a finger thickness, the mounting finger being substantially parallel to and adhering between adjacent windings of the coated filament and thereby displacing a part of the uncured binder, wherein the finger thickness is less than approximately 15 percent of the rim width, the working portion being located opposite the mounting finger and extending above the rim radius to a tip radius, the working portion being configured to generate a low-pressure zone along each fan blade for producing propulsion;

curing the hub;

circumscribing the fan blades with a duct;

dividing the working portion into an inboard length and an outboard length joining at an apex therebetween, the inboard length corresponding to an inboard leading edge extending from the rim surface and the outboard length corresponding to an outboard leading edge extending to a blade tip, the apex being offset from the rim surface by not less than approximately 0.25 inch and by not more than approximately 40% of a blade span spanning the rim surface to the blade tip;

sweeping the outboard leading edge backward from a direction of hub rotation by an outboard sweep angle that is substantially constant from the apex to the blade tip and sweeping the inboard leading edge forward in a direction of hub rotation by an inboard sweep angle that is substantially constant, where the inboard and the outboard sweep angles are each between approximately 30 and approximately 70 degrees;

limiting a ratio of the rim radius to the tip radius to be greater than approximately 0.65 for creating a substantially uniform and supersonic airspeed across the outboard leading edge, for enabling a lightweight blade without flutter, and for producing the supersonic fan in one piece; and where the apex is configured to form a vortex proximate the apex and trailing circumferentially across the fan blades from approximately the direction of hub rotation and substantially confining an inboard flow regime forming proximate to the rim surface to remain inboard of the apex, thereby preserving the low-pressure zone and increasing propulsion for the supersonic fan.

22. The method of claim 21, wherein:

the continuous filament consisting of at least one of the following: glass fiber, carbon fiber, polymer, metal, a plurality of non-woven fibers, unidirectional fabric, para-aramid fiber, ceramic fiber.

23. The method of claim 21, wherein:

the uncured binder consisting of at least one of the following: epoxy resin, polyester, polymer.

24. The method of claim 21, wherein:

each fan blade consisting of at least one of the following: metal, carbon composite, molded composite, laminate composite, ceramic, plastic.

25. The method of claim 21, wherein:

the finger thickness ranges from approximately 0.020 inch to approximately 0.060 inch for resisting bending loads.

26. The method of claim 21, further comprising:

twisting a chord of each fan blade out of the plane of rotation by a blade twist angle approximately about a radial of the hub and within a finger twist zone that is substantially below the rim surface, the blade twist angle setting an angle of attack.

* * * * *